United States Patent [19]

Vecellio et al.

[11] Patent Number: 4,580,002

[45] Date of Patent: Apr. 1, 1986

[54] METHOD AND APPARATUS FOR REPLACING FLAMMABLE OIL IN AN ELECTRICAL CABLE AND CABLE SO TREATED

[75] Inventors: Bernardino Vecellio, Milan; Gianmario Lanfranconi, Trezzo d'Adda, both of Italy

[73] Assignee: Societa Cavi Pirelli S.p.A., Milan, Italy

[21] Appl. No.: 616,319

[22] Filed: Jun. 1, 1984

[30] Foreign Application Priority Data

Jun. 3, 1983 [IT] Italy ..... 21436 A/83

[51] Int. Cl.[4] ..... H01B 9/06

[52] U.S. Cl. ..... 174/11 R; 156/48; 174/12 R; 174/15 C; 174/25 R; 252/570; 252/573

[58] Field of Search ..... 156/48, 285; 174/14 R, 174/25 C, 25 P, 110 S, 11 R, 12 R, 15 C, 15 R; 252/570, 573; 361/315, 319, 327

[56] References Cited

U.S. PATENT DOCUMENTS 3,152,028 10/1964 McLaughlin et al. ..... 156/48
4,234,754 11/1980 Edwards et al. ..... 174/15 R X
4,259,708 3/1981 Mandelcorn ..... 361/319 X
4,372,988 2/1983 Bahder ..... 156/48 X
4,491,684 1/1985 Vecellio ..... 174/25 C X

*Primary Examiner*—Robert A. Dawson
*Attorney, Agent, or Firm*—Brooks Haidt Haffner & Delahunty

[57] ABSTRACT

Method and apparatus for replacing flammable, insulating oil in an oil-filled electric cable by non-flammable, insulating oil in which the flammable oil is withdrawn at least from the cable oil duct under vacuum and with heating of the cable to its maximum operating temperature and thereafter, the flammable oil which was withdrawn is replaced by non-flammable oil. During operation of the cable, oil which flows out of the cable during heating of the cable is sent to a first reservoir, through a check valve and during subsequent cooling, such oil is replaced by non-flammable oil from a second reservoir containing non-flammable oil and connected to the cable duct by a check valve. Also, an oil-filled cable having its insulation impregnated with flammable, insulating oil or a mixture of such oil with non-flammable, insulating oil and having an oil duct filled with a non-flammable, insulating oil which is different from the flammable oil.

24 Claims, 2 Drawing Figures

METHOD AND APPARATUS FOR REPLACING FLAMMABLE OIL IN AN ELECTRICAL CABLE AND CABLE SO TREATED

Reference is made to copending U.S. application Ser. No. 489,956, filed Apr. 29, 1983 and now U.S Pat. No. 4,491,684, which was filed in the name of one of the inventors named in this application and which is assigned to the assignee of this application.

The present invention relates to a process for providing an oil-filled, electric power cable which contains an oil which does not propagate fire and, more particularly, it relates to a process for replacing fire propagating oil in those oil-filled cables which are presently in existence, i.e. wherein to date, the insulating, fluid oil which impregnates said cables is of the type which propagates flames, by an oil which does not propagate fire.

Also, the present invention relates to apparatus for replacing oil in a cable by oil which does not propagate fire, and to an oil-filled, electric cable connected to said apparatus which cable is obtained by the process of the invention.

Oil-filled, power cables generally comprise at least one conductor around which there is provided a solid, stratified insulation, formed by windings of insulating material tapes which are impregnated with an insulating oil and which has at least one longitudinal duct or canal for the movement of the insulating fluid-oil along the cable, such elements being enclosed inside a metallic sheath. In the known electric cables, the insulating fluid oil, selected from mineral oils, alkylbenzenes and the like, which are all flame propagating substances, fills the oil canal of the cable and also impregnates the solid, stratified insulation.

As a consequence of this, should any rupture occur in the cable sheath, the flame propagating, insulating, fluid oil, which is always kept under pressure in the cable, leaks out of the cable, and in the presence of a fire, this fire will be spread because of the leaking oil.

This is one of the reasons why, in those electrical systems which comprise oil-filled insulated cables, provisions are made for the necessary fire extinguishing means.

One object of the present invention is a process for replacing fire propagating or flammable oil in the existing electric oil-filled cables, the insulating fluid oil of which is constituted by mineral oils, alkyl-benzenes and the like, and thereby, contributing to increasing the security measures taken with respect to fire propagation which are furnished by the fire prevention means which are present in the electrical installations using oil-filled cables.

Other objects of the present invention are an electrical installation of an oil-filled cable which provides greater assurance that fire will not be propagated and oil-filled electric cables which do not propagate fires, incorporated in the electrical installation and which are obtained by the process of the present invention.

The process which forms one object of the present invention, is for rendering fire non-propagating those oil-filled electric cables having at least one electrical conductor, a solid stratified insulation disposed around said conductor and impregnated with insulating, fluid oil, at least one duct for the movement of the insulating, fluid oil along the cable, and a metallic sheath, the said process being characterized by the fact of comprising the steps of:

a. removing, under vacuum, at least all the insulating fluid oil existing in the duct while heating the cable to a temperature not lower than the maximum temperature which exists during cable operation; and b. filling the cable with an insulating fluid-oil which is flame non-propagating.

In this specification, by the term "flame non-propagating, insulating fluid oil", is meant any insulating fluid oil, constituted by a single chemical composition or comprising a mixture of chemical compositions, which is satisfactory for impregnating oil-filled cables, and which possesses the following characteristics (1) the value of the characteristic, known to those skilled in the art as the "fire point", which is determined according to the ASTM D93–79 STANDARD (and which represents the temperature of a liquid at which, once the combustion of the vapors emitted by the liquid itself, under the action of an external small flame has commenced, said combustion continues for at least 5 minutes), must be greater than 160° C. and preferably, over 220° C.;

(2) the heat of combustion must be lower than, at most, equal to, 9 kilocal/gr; and (3) the point of auto-ignition, i.e., the temperature of the liquid, at which, in the presence of air, a spontaneous combustion of the liquid itself takes place, must be at least equal to 350° C.

Moreover, the viscosity at 25° C. of a flame non-propagating, insulating, fluid oil, defined above, should be between 5 and 50 cSt and preferably, it should be between 10 and 30 cSt.

In particular, flame non-propagating, insulating, fluid oils, falling within the ambit of the above-stated definition, which prove to be particularly convenient, are polydimethylsiloxanes having the viscosities set forth hereinbefore.

Another example of a particularly convenient flame non-propagating, insulating, fluid oil, according to the present invention, formed by mixtures of chemical compositions, is constituted by a mixture of a polydimethylsiloxane and of an isopropyldiphenyl, the latter being present in the mixture in a quantity which does not exceed 10% by weight with respect to the total weight of the mixture, and preferably, is present in a quantity between 3% and 7% by weight with respect to the total weight of the mixture.

Moreover, the process, according to the invention, for removing the flammable oil from the oil-filled electric cables, during the operation of the cables, comprises the steps of:

(a) removing the insulating fluid-oil present in the cable, when it moves out of the cable during the operation of the latter; and (b) sending a flame non-propagating, insulating, fluid-oil into the cable when, during the operation of the latter, insulating, fluid oil is required in the cable.

In particular, during the phase of removing the insulating, fluid oil (constituted by a mixture of oils) which is moving out of the cable, said insulating, fluid oil is sent, for practical purposes, into a first collecting reservoir whereas, during the phase of supplying flame non-propagating, insulating, fluid-oil into the cable itself, said latter oil is provided by a second reservoir.

A further object of the present invention, is an electrical installation incorporating a flame non-propagating, oil-filled electric cable, characterized by the fact of comprising a first and a second reservoir placed at one extremity of an oil-filled cable, and connected by means of one-way valves to a pipe connected with the cable oil duct, where the first reservoir receives the mixture of insulating, fluid oil exiting from the cable during the thermal heating transients of the latter, and where the second reservoir contains only flame non-propagating, fluid oil to be sent into the cable during the thermal cooling transients of the cable.

A further object of the present invention, is an oil-filled, flame non-propagating cable comprising at least one conductor, a solid stratified insulation impregnated with insulating, fluid oil, disposed around the conductor and constituted by several windings of insulating material tapes, at least one duct for the movement of the insulating, fluid oil along the cable, and a metallic sheath, said cable being characterized by the fact that the insulating, fluid oil, impregnating the solid stratified insulation, is different from the insulating, fluid-oil existing in the oil duct of the cable, the insulating, fluid oil present in the oil duct of the cable being a flame non-propagating, fluid oil.

Other objects and advantages of the present invention will be apparent from the following detailed description of the presently preferred embodiments thereof, which description should be considered in conjunction with the accompanying drawings in which.

Figure 1:
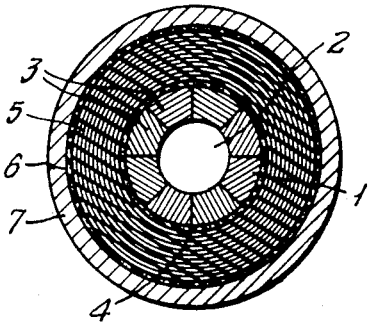
FIG. 1 illustrates a cross-section of one type of an oil-filled cable.

In FIG. 1 there is shown an example of an oil-filled cable, to which the present invention makes reference, which must be considered as merely illustrative. As a matter of fact, although in FIG. 1, there is represented (and described also, further on in this specification) a particular form of unipolar oil-filled cable, the invention is applicable to other known types of unipolar and multipolar oil-filled cables, and to cables known in the art as "in pipe cables".

FIG. 1 is a cross-sectional view of a type of an oil-filled, electric, unipolar cable. As can be seen in FIG. 1, the oil-filled, electric cable comprises a conductor 1 provided in its center with a canal 2 for the movement of the insulating oil along the cable. In the particular embodiment shown, the conductor 1 is in the form of a plurality of stranded structural shapes 3 which are adjacent to one another and which form a duct surrounding the canal 2.

Around the conductor 1, there is a semi-conductive layer 4 and, around this, there is a solid, stratified insulation 5 formed by a plurality of windings of tapes of insulating material, such as, for example, tapes made of natural or synthetic paper.

Around the solid, stratified insulation 5, there is a semi-conductive layer 6, and around this, there is disposed a sheath 7 made of a metallic material, for example, of lead or aluminum.

In the known oil-filled, electric cables, the insulating oil of the cable, i.e., the oil which fills the canal 2 and impregnates the solid, stratified insulation 5, is the same oil, and it is constituted by a mineral oil, alkylbenzenes and such like, i.e., by flame-propagating, insulating oils. It results from this that the known oil-filled cables do not possess any resistance against the propagation of fires.

For rendering the known oil-filled cables, which are briefly described hereinbefore, to be "fire non-propagating", the process of the present invention, comprises the steps hereinafter set forth.

Under vacuum, the maximum possible quantity of insulating, fluid oil which is present in the cable is drained with heating the cable up to a temperature not lower than the maximum temperature of the cable existing during use of the cable. In practice, the cable is heated up to a temperature which is higher, by a few degrees, than the maximum operating temperature of the cable.

By this operation, at least all the insulating, fluid oil in the canal 2, is removed from the cable as well as a part (undefinable with precision) of the insulating, fluid oil impregnating the solid, stratified cable insulation 5. As a matter of fact, the solid, stratified insulation 5, which is formed by windings of insulating material tapes, for example, paper, still retains, through capillary action, some of the impregnating, insulating, fluid oil.

Once this phase of the process is terminated, and while still with keeping the cable under vacuum, the cable is refilled with a "flame non-propagating, insulating, fluid oil", for example, with a polydimethylsiloxane having a viscosity of 20 cSt at 25° C., until the oil pressure inside the cable reaches pre-established values, for example, values of 2 atmospheres.

As an alternative, for the insulating, fluid oil which is flame non-propagating, there can be utilized a mixture of polydimethylsiloxane, selected from among those having the above-defined viscosity values, and isopropyldiphenyl where, in the mixture, the latter is present in a quantity which does not exceed 10% by weight of the total weight of the mixture, and preferably, in a quantity between 3% and 7% by weight with respect to the total weight of the mixture.

As a consequence of these steps, the cable oil canal 2 will be filled only with an insulating, fluid oil which is flame non-propagating, for example, a polydimethylsiloxane having the characteristics given above. However, in the solid, stratified insulation 5, there will still be present a flame propagating, insulating, luid oil containing a certain quantity of the nonflammable oil which fills the cable canal 2.

At this point, the oil-filled cable, obtained through the steps of the process given above, can be put into operation.

Since, during the functioning of the oil-filled cable, an oil movement occurs along the cable and radially to it, owing to thermal transients which occur during use of the cable, there inevitably takes place a mixing-up of the flame non-propagating, insulating, fluid oil present in the canal 2 with the insulating fluid oil in the insulation 5 which latter oil has a different nature and properties and being, in particular, flame propagating.

As a consequence, during cable functioning, the oil in the canal 2 is not only polydimethylsiloxane, which is an example of a flame non-propagating, insulating, luid oil, and instead, there is a mixture of polydimethylsiloxane and of the flame propagating, insulating, fluid oil which impregnates the solid, stratified, cable insulation.

Since, as previously stated, the insulating, fluid oil which impregnates the solid, stratified insulation 5 of the cable, has the characteristics of being flame propagating, it results that during the functioning of the oil-filled cable, because of the oil movements in the radial direction of the cable, the composition of the mixture of oils present in the canal 2 varies, i.e. the composition of the mixture as between polydimethylsiloxane and the flame proagating oil impregating the solid, stratified insulation 5, changes in the direction of reducing the quantity of polydimethylsiloxane with respect to the total quantity of the oil mixture, thereby reducing the flame non-propagating characteristics for said mixture.

The process, according to the present invention, for further improving the fire non-propagating characteristics of the oil-filled electric cables, comprises, during cable functioning, the steps set forth hereinafter.

To remove the mixture of insulating, fluid oils formed in the cable canal 2, as it is formed each time that a cable thermal heating transient takes place, i.e., when the movement of said mixture of oils is out of the cable, said mixture to be eliminated from the cable's oil circuit is directed, for example, into a first collecting reservoir.

To supply the cable canal 2, each time that a thermal cooling transient takes place which requires a supply of oil into the cable, only a flame non-propagating, fluid oil, for example, constituted by a polydimethylsiloxane having a viscosity of 20 cSt at 25° C. or by the previously defined mixture of polydimethylsiloxane and isopropyldiphenyl is supplied to the canal 2 from a source thereof.

Figure 2:
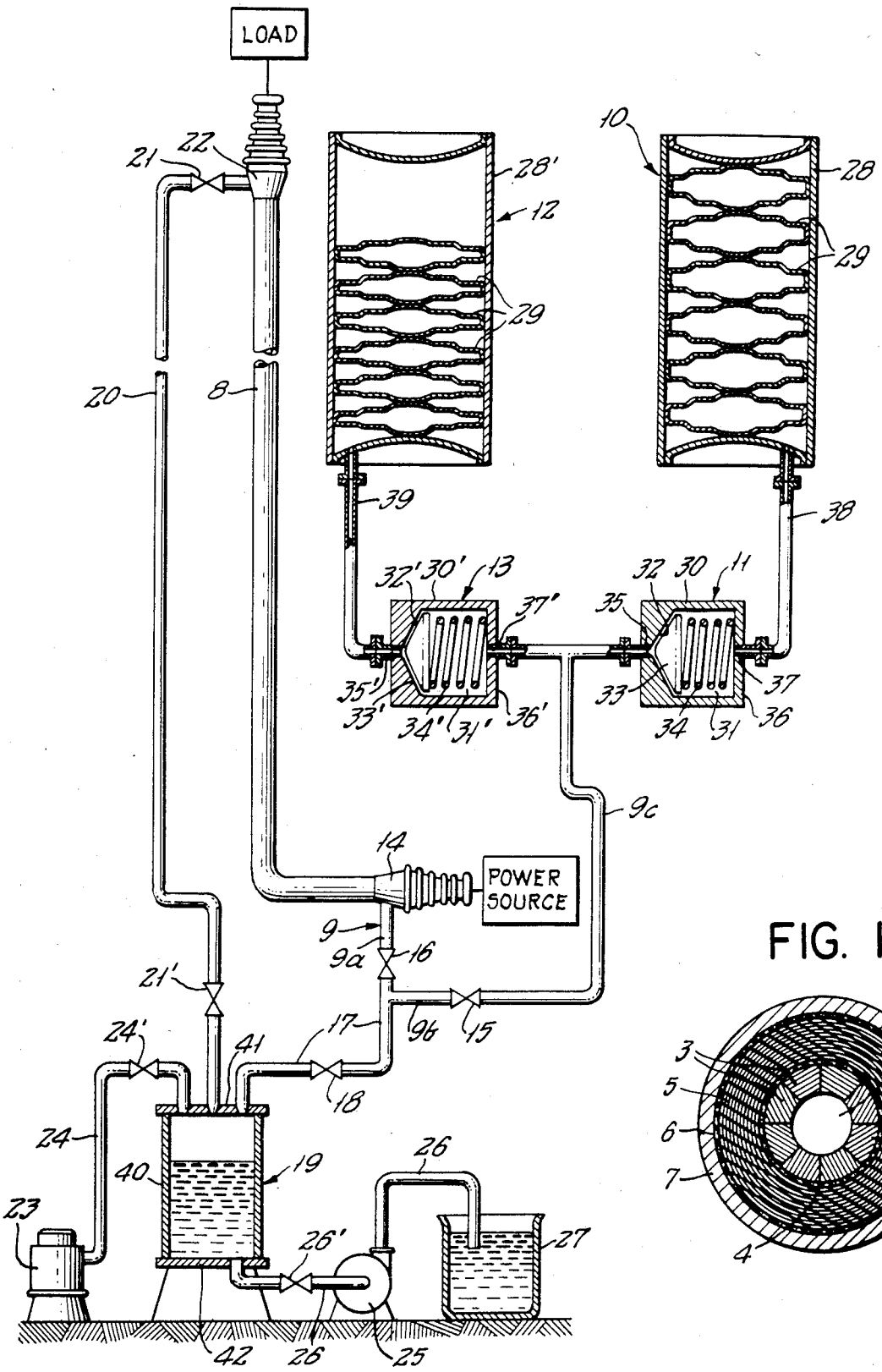
FIG. 2 is a schematic view of an electrical installation including an oil-filled cable and apparatus for replacing flammable insulating oil with non-flammable oil.

For carrying out the latter process, according to the present invention, an installation provided with oil-filled cables is shown schematically in FIG. 2 solely by way of example. FIG. 2 illustrates only those elements which permit putting into practice the process according to this invention.

As one can see from FIG. 2, an installation for oil-filled cables, according to the present invention, for carrying out the above-described process of the invention, comprises an oil-filled cable 8 having a canal 2 which communicates, through a pipe 9, with two reservoirs, with a first reservoir 10, through a nonreturn or check valve 11, and with a second reservoir 12, through a check valve 13. The structures of the reservoirs 10 and 12, and of the valves 11 and 13, will be described later on in this specification.

The pipe 9, comprising three sections 9*a*, 9*b* and 9*c* is connected to the oil canal of the cable 8 at the termination 14 of the latter, i.e. at the cable extremity which is disposed at a minimum height. On-off valves 15 and 16 are connected to the pipe 9.

From the portion 9*b* of the pipe 9, between the on-off valves 15 and 16, there is a branch pipe 17, having an on-off valve 18, which discharges into a vessel 19, known as a "bottle" by those skilled in the art, the structure of which shall be described further on in this specification.

The vessel 19 is connected, through a pipe 20 and on-off valves 21 and 21', to the canal of the cable 8 at the termination 22 which corresponds to the cable extremity having maximum height.

Moreover, the vessel 19 communicates with a vacuum pump 23 through a pipe 24 and an on-off valve 24'. A gear pump 25 is connected by way of pipes 26 and an on-off valve 26', to the vessel 19 and to a container 27.

As previously stated, the oil canal of the cable 8, communicates with a first reservoir 10 and with a second reservoir 12 through the valves 11 and 13 respectively.

The reservoirs 10 and 12 comprise metallic casings 28 and 28' in which a plurality of cells 29 and 29', having undulated metallic walls filled with pressurized gas, are housed. In the spaces between the metallic casings 28 and 28' and the cells 29 and 29' of the reservoirs 10 and 12, there is present a flame non-propagating, insulating, fluid oil, for example, a polydimethylsiloxane having a viscosity of 20 cSt at 25° C.

The first reservoir 10, which collects the oil flowing out from the cable, contains the minimum possible quantity of flame non-propagating, insulating, fluid oil, i.e., the quantity of insulating, fluid oil contained in it corresponds to the minimum value of the operating range of the reservoir itself which is defined further on in the specification. As an alternative, the first reservoir 10 may contain an oil of the flame propagating type.

The second reservoir 12 contains the maximum quantity possible of flame non-propagating, insulating, fluid oil, i.e., the quantity of insulating, fluid oil contained inside it, corresponds to the maximum value of the operating range of the reservoir.

By the term "operating range" of a reservoir, is meant the curve which allows for transforming the pressure values, of the oil housed in the reservoir, into oil volume values to be delivered until the reservoir is completely emptied.

As already stated, the reservoirs 10 and 12 are connected up with the pipe 9 through the valves 11 and 12 respectively. The valve 11 comprises a casing 30 that presents a chamber 31 having a surface, at one wall 32, tapered outwardly so as to have a frusto-conical form. Inside the chamber 31, there is present a frusto-conical valve body 33. A spring 34, pushes the valve body 33 against the frusto-conical surface of the wall 32.

At the wall 32, the casing is provided with a through opening 35, which communicates with the pipe 9, and at the wall 36 of the casing 30, there is present a through opening 37, which communicates, through a pipe 38, with the first reservoir 10.

The valve 13, has a structure identical to the structure of the valve 11, (and hence, its components are identified in FIG. 2 with the same reference numerals, with prime marks, utilized for indicating the elements of the valve 11). However, the valve 13 is disposed in such a way that the through opening 35' present in the valve casing is in communication with the second reservoir 12 through a pipe 39 whereas the through opening 37' is in communication with the pipe 9.

As shown in FIG. 2, the oil-filled cable 8 is connected to the vessel or "bottle" 19. The vessel or "bottle" 19, comprises a cylindrical casing 40 that is sealed in a fluid-tight manner at its ends by the lids 41 and 42. In the lid 41, there are through-holes for putting the interior of the vessel or "bottle" 19 into communication with the vacuum pump 23, through the pipe 24, and the on-off valve 24', with the termination 22 of the cable 8 through the pipe 20 and the on-off valves 21 and 21' and with the pipe 17 for the connector, and hence, with the termination 14 of the cable 8 through the pipe 9.

In the bottom lid 42, there is a through-hole for putting the interior of the vessel or "bottle" 19 in communication with the gear pump 25 through the pipe 26 and the on-off valve 26'.

The functioning of the apparatus illustrated in FIG. 2, by which the process according to the invention is carried out, is described hereinafter.

With the on-off valve 15 closed, and with the on-off valves 16, 18, 21, 21' and 24' open, the vacuum pump 23 is turned on. In this way, the flame propagating, insulating, fluid oil, which is contained under pressure, for example, at 2 atm, inside the cable 8 and which may be a mineral oil or alkylbenzenes, enters into the vessel or "bottle" 19. As such insulating fluid oil enters inside the vessel 19, the valve 26' is opened and the gear pump 25 is made to function which sends oil into the receptacle 27. Moreover, for the entire periods of time during which the oil is drawn from the cable, and during which flame non-propagating oil is subsequently introduced into the cable, the vacuum pump 23 is kept functioning.

While the flame propagating, insulating, fluid oil contained in the cable 8 is being extracted through suction, the cable is heated, for example, by causing an electric current to pass through the cable conductor, to a temperature of some degrees higher than the maximum temperature had during use of the cable to transmit electric power so as to be able to extract from the cable the maximum possible quantity of flame propagating, insulating, fluid oil. At the end of the above-given operations, at least all the insulating, fluid oil which was in the cable oil canal, is drawn away, while a good part of the impregnating oil of the solid, stratified, cable insulation remains in the insulation, such oil being held by the capillary action of the paper tapes.

At this point, the on-off valve 18 is closed, while the on-off valve 15 is opened for thus putting the pipe portion 9*c*, filled with flame non-propagating, insulating, fluid oil, in communication with the oil canal of cable 8 at the termination 14 of said cable.

In doing so, a pressure drop is created in the pipe portion 9*c*, and this pressure drop causes the check valve 13 to open because, due to the pressure difference existing between the upstream and downstream sides of the valve 13, the frusto-conical valve body 33', moves away from the frusto-conical wall 32' against the force of the spring 31'. In this manner, the flame non-propagating, insulating, fluid oil, for example, a polydimethylsiloxane having a viscosity of 20 cSt at 25° C. which is contained in the second reservoir 12, enters into the cable 8, filling it completely. As soon as the cable 8 has been filled with the fluid oil coming from the second reservoir 12, the on-off valves 21, 21', 24', 26' are shut, and the vacuum pump 23 and the gear pump 25 stop functioning.

By already known means (not shown in FIG. 2), the flame non-propagating, insulating, fluid oil is introduced into the second reservoir 12 in such a way as to bring its condition up to the maximum value in the operating range. This operation can be repeated, whenever it is necessary, at intervals during the service lifetime of the cable, for assuring that said reservoir 12 will always be able to supply a flame non-propagating, insulating, fluid oil.

Moreover, during the lifetime of the cable, whenever it proves to be necessary, the flame non-propagating, insulating, fluid oil which is housed in the reservoir 12 can also be modified by using additives which however, do not alter their flame nonpropagating properties, for satisfying every demand of the cable itself. For example, in the example of employing only polydimethylsiloxane as a flame non-propagating, insulating, fluid oil (said substance possessing a low capacity for absorbing the gases formed through the decomposition of papers), isopropyldiphenyl may be added in the quantities given previously, whenever the quantity of the flame propagating, insulating, fluid oil, present in the stratified cable insulation has descended below a value which does not permit any absorption of the above said gases. The reasons for this will appear clear from what will be stated hereinafter.

At this point, the cable 8 has an oil canal which is completely filled with flame non-propagating, insulating, fluid oil whereas the solid, stratified insulation contains some flame propagating, insulating, fluid oil.

The electrical installation of an oil-filled cable, according to the present invention, can be used for transmitting electrical power. During the functioning of the installation, thermal transients take place in the cable, i.e., the cable is subjected to heating and to cooling, and therefore, it undergoes expansions and contractions which produce movements of the oil in the cable. Hence, during these thermal changes, a movement takes place of the oil along the cable and radially to the cable. As a consequence, a mixing-up takes place between the flame non-propagating, insulating, fluid oil and the flame propagating, fluid oil, which continue to vary in their composition.

In particular, during the functioning of the cable, two mixtures are formed, one mixture in the cable oil canal and another mixture in the solid, stratified insulation.

What is important, for the problem relating to the characteristic of not spreading fires, is the mixture, containing both flame propagating oils as well as flame non-propagating oils, which is formed in the oil canal of the cable.

As a matter of fact, during cable functioning, the variation in the composition of the mixture of oils present in the cable oil canal, is in the direction of increasing the quantity of flame propagating, insulating, fluid oil coming from the solid, stratified insulation with the consequent reduction of the fire non-spreading property of the cable itself.

For preventing this situation from occurring, during the thermal heating transients which cause a movement of the mixture of the insulating fluid oils out from the cable, i.e., when the movement of the oil mixtures inside the pipe 9 is directed towards the reservoirs, the check valve 13 remains closed whereas the valve 11 allows the mixture of oils to enter into the first reservoir 10.

When the mixture of insulating fluid oils moves out of the cable 8, the pressure inside the pipe 9 is greater than the pressure existing inside the pipe 38, and therefore, due to the effect of this difference in pressures, the valve body 33 moves away from the truncated cone wall 32 of the valve casing, by overcoming the resistance of the spring 34, and hence, the valve 11 opens. However, the valve 13 remains closed since the pressure, existing inside the pipe 9, cooperates with the spring 34' in keeping the body 33' of the valve 13 against the truncated cone wall 32' and hence, in keeping the valve 13 closed.

In the thermal cooling transients, during which the insulating, fluid oil is returned into the cable 8, i.e., when the movement of the insulating fluid oil inside the pipe 9 is directed towards the cable 8, the valve 13 opens, while the valve 11 remains closed, and the flame non-propagating, insulating, fluid oil contained in the second reservoir 12 enters the cable 8. As a matter of fact, when the movement of the oil in the pipe 9 is directed towards the cable 8, there is a drop of pressure in the latter, and the difference of pressure between the oil in the pipe 39 and the oil in the pipe 9 causes the body 33' of valve 13 to move away from the truncated cone wall 32' and hence, the valve 13 opens.

Consequently, during the thermal cooling transients which demand a flow of insulating fluid oil toward the cable 8, only insulating, fluid oil having flame non-propagating properties, contained in the reservoir 12, flows into the cable 8. In this way, flame propagating oil is frequently removed from the canal of the cable 8 and replaced by flame non-propagating oil which substantially prevents the presence in the canal of flame propagating oil. It has been found experimentally, that in the canal for the movement of the insulating, fluid oil along the cable, there results at all times an insulating, fluid oil possessing the characteristic of not being flame propagating.

In fact, in the canal for the movement of the insulating fluid oil along the cable, the oil present is constituted by one of the following alternatives:

a. the oil is constituted only by the flame nonpropagating, insulating, fluid oil with which the cable is supplied, and which can be, for example, a polydimethylsiloxane selected from those previously given, or from a mixture of polydimethylsiloxane and isopropyldiphenyl, also previously stated; and b. the oil is constituted by a mixture of flame nonpropagating, insulating, fluid oil, with which the cable is supplied, and mineral oils or alkylbenzenes coming from the cable insulation, such latter oils being present in a quantity not greater than 5% of the total weight of the mixture.

Hence, said mixture possesses the characteristic of being flame non-propagating.

For having a better understanding of the experimental fact given hereinbefore, one must understand that the volume of the insulating, fluid oil housed in the cable canal constitutes only a small part of the insulating, fluid oil contained inside the oil-filled cable. For example, for a 400 kV. of oil-filled cable having an electric conductor with a section of 1000 $mm^2$ and an oil canal having a diameter of 12 mm, the volume of the insulating, fluid oil contained in the solid, stratified, insulation is 90%, while the volume of the oil housed in the canal, is only about 10%.

With a thermal temperature change between ambient temperature (20° C. approx.) and 90° C. , i.e., a temperature change of about 70° C. , the volume variation, which all of the cable's insulating, fluid oil undergoes, is around about 5%, i.e., it is around values that are equivalent to half the capacity of the cable oil canal.

This signifies that with each thermal heating change, a volume of oil, which is equal to half the volume of the oil housed in the cable canal, is drained off. During a thermal cooling change, an equal quantity of flame non-propagating, insulating, fluid oil, for example, a polydimethylsiloxane, is substituted.

Such explanation conforms to the experimental fact mentioned previously.

Within the scope of the present invention, there is also included a fire non-spreading oil-filled cable which is obtained through the process described.

An oil-filled electric cable, according to the invention, which does not spread fires is characterized by the fact that the insulating, fluid oil existing in the cable oil canal, is a flame non-propagating oil, i.e., an oil different from the one impregnating the solid, stratified insulation which is a flame propagating oil.

In particular, inside the oil canal of a cable according to the present invention, there is present, either a single flame non-propagating, insulating, fluid oil, such as, for example, a polydimethylsiloxane having a viscosity of 20 cSt at 25° C., or else, a flame non-propagating, mixture of insulating fluid oils mixed with the flame propagating, fluid oils used for impregnating the solid, stratified insulation comprising, for example, mineral oils or alkylbenzenes, the latter being present in quantities which do not exceed 5% in weight with respect to the total weight of the mixture itself. For example, the mixture may be a polydimethylsiloxane, having a viscosity of 20 cSt at 25° C., and mineral oils or alkylbenzenes where these latter are present in a quantity which does not exceed 5% in weight with respect to the total weight of the mixture itself.

In the solid, stratified insulation of a cable according to the present invention, there is present a mixture of oils, the composition of which varies during the entire lifetime of the cable. Said mixture is constituted by a flame propagating, fluid oil, such as mineral oils or alkylbenzenes, and by a flame non-propagating, insulating, fluid oil, such as, for example, polydimethylsiloxane.

From the description given herein of a process according to the invention for obtaining electric oil-filled cables which are fire non-propagating, of an electrical installation including oil-filled cables according to the invention and of an electric oil-filled cable of the invention, one can comprehend how the objects of the invention are obtained.

It has been found that, in the instance of ruptures occurring at any point of an electric oil-filled cable, the oil, leaking from the cable, is constituted essentially by the oil which is in the cable canal and not by the oil which impregnates the solid, stratified insulation of the cable itself. This latter oil, is held back through the capillaries of the insulating material tapes which constitutes the said solid, stratified insulation.

Consequently, during a fire breakout, should any rupture occur in an oil-filled cable of the present invention, the insulating, fluid oil, which can leak out from the cable, is flame non-propagating and cannot feed or spread the fire.

Moreover, should polydimethylsiloxanes be employed as the insulating, fluid oils for rendering the electric oil-filled cables fire non-spreading, such polydimethylsiloxanes are particularly effective due to the fact that, in the presence of a fire, a decomposition of the polydimethylsiloxane vapors takes place with the formation of silicon which is substantially incombustible. Such silicon covers both the cable and its surroundings thereby improving even further the protection against the fire spreading.

Accordingly, there is a safeguard in addition to what has already been conferred by those anti-fire means which are present in the electrical connections of oil-filled cables.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. Method for replacing fire propagating, insulating oil in an oil-filled, electric cable having at least one conductor, a metallic sheath around said conductor with its interior surface spaced from said conductor, insulation impregnated with said oil around said conductor and intermediate said conductor and said sheath and a longitudinally extending oil canal within said sheath for supplying said oil to and removing said oil from said insulation, said canal having said oil therein, said method comprising:

removing said oil from at least said canal while at least the oil in said canal is heated to at least the maximum cable operating temperature, above ambient temperature; and when at least oil in said canal has been withdrawn, refilling at least said canal with a flame non-propagating, insulating, fluid oil.

2. The method as set forth in claim 1 wherein said oil is withdrawn by subjecting said oil in said canal to suction.

3. The method as set forth in claim 2 wherein said canal extends longitudinally within said conductor and said oil in said canal in heated by causing electric current to flow in said conductor.

4. The method as set forth in claim 1 wherein said flame non-propagating, insulating, fluid oil is a polydimethylsiloxane having a viscosity at 25° C. in the range from about 5 to about 50 centistokes.

5. The method as set forth in claim 4 wherein the viscosity of the polydimethylsiloxane at 25° C. is between 10 and 30 centistokes.

6. The method as set forth in claim 1 wherein said flame non-propagating, insulating oil comprises a mixture of polydimethylsiloxane having a viscosity at 25° C. in the range from about 5 to 50 centistokes and isopropyldiphenyl, the latter being present in an amount not exceeding 10% by weight of the weight of the mixture of polydimethylsiloxane and isopropyldiphenyl.

7. The method as set forth in claim 6 wherein the viscosity of the polydimethylsiloxane at 25° C. is between 10 and 30 centistokes.

8. The method as set forth in claim 1 wherein said cable is in operation and has a source of electric current connected to one end of said conductor and a load connected to the other end of said conductor, whereby said cable is subjected to heating and cooling with changes in the magnitude of the current flowing on said conductor and causes said flame propagating oil to flow out of said canal with heating of said cable and wherein said oil which flows out of said canal is retained outside said cable and when oil is subsequently required to fill said cable, said flame non-propagating, insulating oil is supplied to said canal.

9. The method as set forth in claim 8 wherein said flame non-propagating, insulating, fluid oil is a polydimethylsiloxane having a viscosity at 25° C. in the range from about 5 to about 50 centistokes.

10. The method as set forth in claim 9 wherein the viscosity of the polydimethylsiloxane at 25° C. is between 10 and 30 centistokes.

11. The method as set forth in claim 8 wherein said flame non-propagating, insulating oil comprises a mixture of polydimethylsiloxane having a viscosity at 25° C. in the range from about 5 to 50 centistokes and isopropyldiphenyl, the latter being present in an amount not exceeding 10% by weight of the weight of the mixture of polydimethylsiloxane and isopropyldiphenyl.

12. The method as set forth in claim 11 wherein the viscosity of the polydimethylsiloxane at 25° C. is between 10 and 30 centistokes.

13. In electric cable installation comprising an oil-filled, electric cable having at least one conductor, insulation around said conductor which is impregnated with oil and a longitudinally extending oil canal, the combination therewith of:

a first oil reservoir connected to said canal through a one-way valve which permits oil to flow from said canal to said first reservoir but prevents oil flow in the opposite direction; and a second oil reservoir containing a flame non-propagating, insulating, fluid oil and connected to said canal through a one-way valve which permits said last-mentioned oil to flow from said second reservoir to said canal but prevents oil-flow in the opposite direction whereby during heating of said cable to above ambient temperature by the flow of electric current through said conductor, oil flows out of said canal and into said first reservoir and during subsequent cooling of said cable, oil flows from said second reservoir into said canal.

14. An electric cable installation as set forth in claim 13 wherein said flame non-propagating, insulating, fluid oil is a polydimethylsiloxane having a viscosity at 25° C. in the range from about 5 to about 50 centistokes.

15. An electric cable installation as set forth in claim 14 wherein the viscosity of the polydimethylsiloxane at 25° C. is between 10 and 30 centistokes.

16. An electric cable installation as set forth in claim 13 wherein said flame non-propagating, insulating fluid oil comprises a mixture of polydimethylsiloxane having a viscosity at 25° C. in the range from about 5 to 50 centistokes and isopropyldiphenyl, the latter being present in an amount not exceeding 10% by weight of the weight of the mixture of polydimethylsiloxane and isopropyldiphenyl.

17. An electric cable installation as set forth in claim 16 wherein the viscosity of the polydimethylsiloxane at 25° C. is between 10 and 30 centistokes.

18. An oil-filled electric cable comprising a conductor, a metallic sheath around said conductor with its interior surface spaced from said conductor and solid insulation around said conductor and intermediate said sheath and said conductor, said insulation being impregnated with an oil comprising a first insulating oil and said cable having a longitudinal oil canal within said sheath in fluid communication with said insulation, and a second insulating oil, different from said first insulating oil, in said canal, said second insulating oil being a flame non-propagating, insulating, fluid oil.

19. An oil-filled electric cable as set forth in claim 18 wherein said second insulating oil is a polydimethylsiloxane having a viscosity at 25° C. in the range from about 5 to about 50 centistokes.

20. An oil-filled electric cable as set forth in claim 19 wherein the viscosity of the polydimethylsiloxane at 25° C. is between 10 and 30 centistokes.

21. An oil-filled electric cable as set forth in claim 18 wherein said second insulating oil comprises a mixture of polydimethylsiloxane having a viscosity at 25° C. in the range from about 5 to 50 centistokes and isopropyldiphenyl, the latter being present in an amount not exceeding 10% by weight of the weight of the mixture of polydimethylsiloxane and isopropyldiphenyl.

22. An oil-filled electric cable as set forth in claim 19 wherein the viscosity of the polydimethylsiloxane at 25° C. is between 10 and 30 centistokes.

23. An oil-filled electric cable as set forth in claim 18 wherein said second insulating oil comprises a mixture of polydimethylsiloxane having a viscosity at 25° C. between about 5 and about 50 centistokes and said first insulating oil, said first insulating oil being a flame propagating oil and being present in an amount not exceeding 5% by weight of the total weight of said first insulating oil and said second insulating oil.

24. An oil-filled electric cable as set forth in claim 23 wherein said mixture further comprises isopropyldiphenyl in an amount not exceeding 10% by weight of the polydimethylsiloxane.

* * * * *

UNITED STATES PATENT AND TRADEMARK OFFICE

CERTIFICATE OF CORRECTION

PATENT NO. : 4,580,002

DATED : April 1, 1986

INVENTOR(S) : Bernardino Vecellio et al

It is certified that error appears in the above-identified patent and that said Letters Patent is hereby corrected as shown below:

Col. 4, line 42, "luid" should read --fluid--;

Col. 4, line 58, "luid" should read --fluid--;

Claim 3, line 3, "in" (second occurrence) should read --is--.

Signed and Sealed this

*Twenty-ninth* Day of *July 1986*

[SEAL]

*Attest:*

DONALD J. QUIGG

*Attesting Officer*

*Commissioner of Patents and Trademarks*